US009609916B2

(12) United States Patent
Song et al.

(10) Patent No.: US 9,609,916 B2
(45) Date of Patent: Apr. 4, 2017

(54) LOOM FOR WEAVING FABRIC WITH TWO TYPES OF TISSUE, SHOE UPPER WOVEN USING THE SAME, AND SHOE

(71) Applicants: Soo Bok Song, Busan (KR); Jae Woo Lee, Daegu (KR)

(72) Inventors: Soo Bok Song, Busan (KR); Jae Woo Lee, Daegu (KR)

(73) Assignee: Soo Bok Song, Busan (KR)

( * ) Notice: Subject to any disclaimer, the term of this patent is extended or adjusted under 35 U.S.C. 154(b) by 0 days.

(21) Appl. No.: 14/733,809

(22) Filed: Jun. 8, 2015

(65) Prior Publication Data

US 2016/0309843 A1 Oct. 27, 2016

(30) Foreign Application Priority Data

Apr. 24, 2015 (KR) ..... 10-2015-0058048

(51) Int. Cl.

| | |
|---|---|
| ***A43B 1/04*** | (2006.01) |
| ***A43B 23/02*** | (2006.01) |
| ***D03C 3/00*** | (2006.01) |
| ***D03C 7/00*** | (2006.01) |
| ***D03D 41/00*** | (2006.01) |
| ***D03D 1/00*** | (2006.01) |
| ***A43B 7/06*** | (2006.01) |

(52) U.S. Cl.

CPC ..... *A43B 23/0205* (2013.01); *A43B 1/04* (2013.01); *A43B 7/06* (2013.01); *A43B 23/0245* (2013.01); *D03C 3/00* (2013.01); *D03C 7/00* (2013.01); *D03D 1/00* (2013.01); *D03D 41/00* (2013.01)

(58) Field of Classification Search

CPC .. A43B 1/04; A43B 7/06; A43B 23/00; A43B 23/0205

See application file for complete search history.

(56) References Cited

U.S. PATENT DOCUMENTS 8,800,606 B2 * 8/2014 Cross ..... D03J 1/00 139/116.1
8,839,824 B2 * 9/2014 Cross ..... D06B 1/00 139/50

(Continued)

FOREIGN PATENT DOCUMENTS

KR 10-2004-0088150 A 10/2004
KR 10-2008-0093184 A 10/2008

(Continued)

OTHER PUBLICATIONS

Korean Office Action dated Jun. 17, 2015, issued to Korean Application No. 10-2015-0058048.

(Continued)

*Primary Examiner* — Marie Bays
(74) *Attorney, Agent, or Firm* — Stein IP, LLC

(57) ABSTRACT

Disclosed herein are a loom for weaving a fabric with two types of tissue, a shoe upper woven using the loom, and a shoe including such a shoe upper. The loom includes a first heddle stack formed by arranging a plurality of first heddles in one or more rows, and a second heddle stack formed by arranging a plurality of second heddles in one or more rows, the second heddles being different in kind from the first heddles. The first heddle stack and the second heddle stack are sequentially arranged in a warp feeding direction.

5 Claims, 10 Drawing Sheets

(56) References Cited

U.S. PATENT DOCUMENTS

| | | | | |
|---|---|---|---|---|
| 2013/0186505 | A1* | 7/2013 | Cross | D03J 1/00 139/11 |
| 2013/0186506 | A1* | 7/2013 | Cross | D06B 1/00 139/68 |
| 2013/0189890 | A1* | 7/2013 | Cross | D06B 1/00 442/200 |
| 2013/0190917 | A1* | 7/2013 | Cross | D06B 1/00 700/140 |
| 2014/0173932 | A1* | 6/2014 | Bell | A43B 1/04 36/84 |
| 2014/0173933 | A1* | 6/2014 | Bell | A43B 1/04 36/84 |
| 2014/0173934 | A1* | 6/2014 | Bell | A43B 1/04 36/84 |
| 2015/0038040 | A1* | 2/2015 | Gabbay | D03D 15/0061 442/189 |
| 2015/0167208 | A1* | 6/2015 | Bischoff | B29C 70/22 442/59 |

FOREIGN PATENT DOCUMENTS

| | | | |
|---|---|---|---|
| KR | 10-2009-0033764 | A | 4/2009 |
| KR | 10-0932657 | B1 | 10/2009 |
| KR | 10-1081211 | B1 | 11/2011 |
| KR | 10-2014-0011737 | A | 1/2014 |
| KR | 10-1364257 | B1 | 2/2014 |
| KR | 10-1419495 | B1 | 7/2014 |

OTHER PUBLICATIONS

Notice of Allowance dated Sep. 11, 2015, issued to Korean Application No. 10-2015-0058048.

* cited by examiner

LOOM FOR WEAVING FABRIC WITH TWO TYPES OF TISSUE, SHOE UPPER WOVEN USING THE SAME, AND SHOE

CROSS-REFERENCE TO RELATED APPLICATIONS

This application claims the benefit of priority to Korean Application No. 10-2015-0058048, filed Apr. 24, 2015, in the Korean Intellectual Property Office. All disclosure of the document named above is incorporated herein by reference.

BACKGROUND OF THE INVENTION

1. Field of the Invention

The present invention relates to a loom for weaving a fabric with two types of tissue, a shoe upper woven using the loom, and a shoe including such a shoe upper. More particularly, the invention relates to a loom for weaving a fabric with two types of tissue, in which leno heddles and jacquard heddles are arranged in combination to allow a leno tissue and a jacquard tissue to be simultaneously woven, a shoe upper woven using the loom, and a shoe including such a shoe upper.

2. Description of the Related Art

A loom is a machine that weaves a fabric by crossing warp and weft. This machine is operated as follows: if some of warp is lifted during the passage of weft, warp threads are spaced apart from each other to create sheds, and then the weft passes through the sheds, thus weaving a fabric. A shedding device for causing warp threads to be spaced apart from each other may be typically classified into a cam (tappet)-type shedding device, a dobby-type shedding device, a jacquard-type shedding device, etc.

Since a general dobby loom may use a few to several dozen harness frames by the dobby-type shedding device, this loom is known to be suitable for a small pattern fabric.

In contrast, a jacquard loom is configured such that one or more heddles are connected to one harness cord connected to jacquard, and one strand of warp passes through each heddle. A vertical movement of the harness cord leads to the shedding movement of the warp. This jacquard loom is also referred to as a card lacing machine. Such a jacquard loom may be used to make various patterns including a large pattern as well as a small pattern, as in the case of a dobby loom. Moreover, the jacquard loom is widely known to be suitable for making a complicated pattern.

The loom is generally configured to include a heddle device, a reed, a warp beam, a fabric beam and the like. Particularly the heddle device may be determined depending on a fabric or tissue structure that is to be woven. For example, a leno heddle device should be used to weave a leno tissue or fabric, while a jacquard heddle should be used to weave a jacquard tissue or fabric.

As is known to those skilled in the art, the leno fabric is a fabric that is woven by crossing two strands of warp in opposite directions about weft such that the two strands of warp are twisted relative to each other. This leno fabric is high in shape stability, and is usable for clothes requiring air permeability, an onion net, a towel and the like.

In order to form such a leno fabric, a weaving apparatus equipped with a heddle for a leno fabric is used. The weaving apparatus equipped with the leno heddle is disclosed in Korean Patent Laid-Open Publication Nos. 10-2009-0033764 and 10-2007-0036755. As disclosed in the cited documents, it is possible to weave the fabric having the leno tissue using the leno heddle.

As described above, the jacquard fabric may be used to make various patterns from small patterns to the large patterns. Therefore, jacquard fabric is mainly applied to clothes, curtains, garments and the like requiring various designs. Particularly, it is possible to manufacture a shoe upper requiring various designs using the jacquard fabric.

In order to weave such a jacquard fabric, the jacquard loom is employed. In Korean Patent No. 10-1419495, a conventional jacquard loom is disclosed.

As such, the conventional loom is problematic in that it adopts only one kind of heddle, that is, the leno heddle or the jacquard heddle, so that it is impossible to weave a fabric having two types of tissue at once.

However, if a fabric can be woven using two types of tissue simultaneously, it is possible to increase productivity and provide an innovative product. For example, in the case of the shoe upper requiring a constant shape, various designs, and air permeability, there is urgently needed a loom for simultaneously weaving the jacquard tissue and the leno tissue.

The foregoing is intended merely to aid in the understanding of the background of the present invention, and is not intended to mean that the present invention falls within the purview of the related art that is already known to those skilled in the art.

DOCUMENTS OF RELATED ART (Patent Document 1) Korean Patent Laid-Open Publication No. 10-2009-0033764.

(Patent Document 2) Korean Patent Laid-Open Publication No. 10-2007-0036755.

(Patent Document 3) Korean Patent No. 10-1419495.

SUMMARY OF THE INVENTION

Accordingly, the present invention has been made keeping in mind the above problems occurring in the related art, and an object of the present invention is intended to propose a loom for weaving a fabric with two types of tissue, in which leno heddles and jacquard heddles are arranged in combination to allow a leno tissue and a jacquard tissue to be simultaneously woven according to the properties of a product.

Particularly, another object of the present invention is intended to propose a loom for weaving a fabric with two types of tissue, in which a jacquard tissue that is a base member of a shoe upper and a leno tissue that forms a ventilation part are simultaneously woven, thus obviating additional cutting and sewing processes.

A further object of the present invention is to propose a shoe upper woven using a loom for weaving a fabric with two types of tissue, and a shoe including such a shoe upper.

In order to achieve the above objects, according to one aspect of the present invention, there is provided a loom for weaving a fabric with two types of tissue, including a first heddle stack formed by arranging a plurality of first heddles in one or more rows; and a second heddle stack formed by arranging a plurality of second heddles in one or more rows, the second heddles being different in kind from the first heddles, wherein the first heddle stack and the second heddle stack are sequentially arranged in a warp feeding direction.

Each of the first heddles may be a leno heddle, and each of the second heddles may be a jacquard heddle. First warp and second warp may be fed through the leno heddle, and third warp may be fed through the jacquard heddle. The first warp and the second warp may be preferably arranged not to interfere with the third warp.

Preferably, the first heddle stack may be located in front of the second heddle stack with respect to the warp feeding direction.

The first warp and the second warp may be interwoven with weft to form leno tissue, and the third warp may be interwoven with the weft to form jacquard tissue.

The first warp may be fed through a warp hole of the leno heddle and the second warp may be moved along a circumference of the warp hole.

Preferably, the loom for weaving the fabric with two types of tissue according to the present invention may further include a first warp beam around which the first warp and the third warp are wound, and a second warp beam around which the second warp is wound.

The jacquard heddle may be used to weave a jacquard tissue fabric that forms a panel defining a shape of a shoe upper, and the leno heddle may be used to weave a leno tissue fabric that forms a ventilation part having a vent hole.

The jacquard tissue fabric may further include a ventilation part having a vent hole formed on the panel, depending on a tissue density of the fabric.

The loom for weaving the fabric with two types of tissue according to the present invention may further include a control unit controlling each of the first and second heddles so as to simultaneously weave a fabric having two types of tissue according to a preset design.

Further, there is provided a shoe upper woven by a fabric having two types of tissue, including a first fabric forming a panel to maintain a shape, and a second fabric having a tissue structure different from that of the first fabric, and having a vent hole to form a ventilation part, wherein the first fabric and the second fabric may be continuously woven simultaneously.

The first fabric may include a ventilation part having a vent hole formed depending on a tissue density, and the second fabric may include the ventilation part having the vent hole due to the tissue structure thereof. Preferably, the first fabric may be a jacquard tissue fabric, and the second fabric may be a leno tissue fabric.

Further, there is provided a shoe having the shoe upper. That is, there may be provided a shoe having the shoe upper, which may include a first fabric forming a panel to maintain a shape, and a second fabric having a tissue structure different from that of the first fabric and having a vent hole to form a ventilation part, wherein the first fabric and the second fabric may be continuously woven simultaneously.

According to the present invention, the leno heddles and the jacquard heddles are arranged in combination, thus allowing the fabric with two types of tissue, such as the leno tissue and the Jacquard tissue, to be simultaneously woven.

Further, according to the present invention, the jacquard tissue that is the base member of the shoe upper and the leno tissue that forms the ventilation part may be simultaneously woven, thus obviating additional cutting and sewing processes for forming the ventilation part and thereby increasing the productivity of the product.

Furthermore, according to the present invention, the ventilation part of the shoe upper is formed of the leno tissue fabric, and is thus capable of providing a shoe upper and a shoe having air permeability, shape stability and lightness.

Additional aspects and/or advantages of the invention will be set forth in part in the description which follows and, in part, will be obvious from the description, or may be learned by practice of the invention.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE EMBODIMENTS

Figure 1:
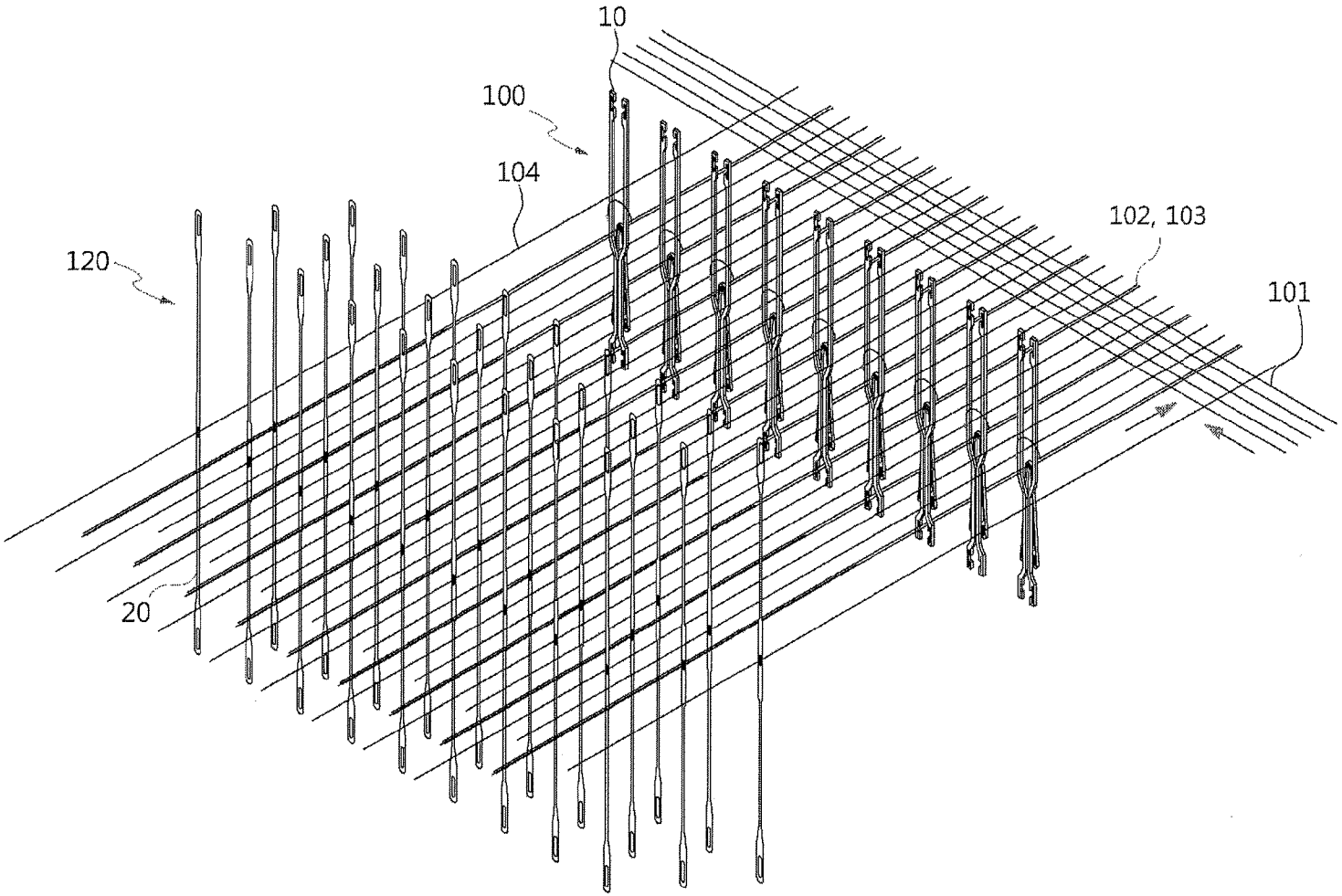
FIG. 1 is a view illustrating the arrangement of heddles that are applied to a loom for weaving a fabric with two types of tissue according to an embodiment of the present invention.

Hereinafter, preferred embodiments of the present invention will be described in detail with reference to the accompanying drawings. However, embodiments of the present invention may be changed in various ways, and the scope of the invention is not limited to the following embodiments. The shape and size of elements in drawings may be exaggerated for the clarity of description.

Like reference numerals are used to identify like elements throughout different drawings. Further, in the following description, if it is decided that the detailed description of a known function or configuration related to the invention makes the subject matter of the invention unclear, the detailed description is omitted.

Further, when describing the elements of the present invention, terms such as first, second, A, B, (a) or (b) may be used. Since these terms are provided merely for the purpose of distinguishing the elements from each other, they do not limit the nature, sequence or order of the elements. It should be understood that when an element is described to be "connected", "coupled" or "joined" to another element, it may be connected or joined directly to the other element or an intervening element may be present.

Further, a concept related to a shoe including an upper of the present invention may be applied to various types of athletic shoes, for example, running shoes, training shoes, hiking shoes, basketball shoes, volleyball shoes, golf shoes, cycling shoes, football shoes, tennis shoes, and soccer shoes. Furthermore, this concept may also be applied to non-athletic shoes, for example, dress shoes, casual shoes, sandals, and work boots.

Herein, a term "leno heddle stack" refers to a group having a plurality of heddles that are used to weave a leno tissue, and a term "jacquard heddle stack" refers to a group having a plurality of heddles that are used to weave a jacquard tissue.

Further, herein, a term "standard yarn" refers to one fixed strand of warp among two strands of warp forming the leno tissue, and a term "leno yarn" refers to the other strand of warp contributing to the twist shape of the leno tissue. However, in some cases, the standard yarn may be referred to as first warp, and the leno yarn may be referred to as second warp.

FIG. 1 is a view illustrating the arrangement of heddles that are applied to a loom for weaving a fabric with two types of tissue according to an embodiment of the present invention.

Referring to FIG. 1, the loom for weaving the fabric with the two types of tissue according to the embodiment of the present invention includes a leno heddle stack 110 and a jacquard heddle stack 120.

The leno heddle stack 110 serves to weave the leno tissue. Such a leno tissue fabric woven by the leno heddle stack 110 is loosely woven and is very low in slip occurrence rate of a weaving position, so that the leno tissue fabric is useful to produce a product requiring both shape stability and air permeability.

The jacquard heddle stack 120 serves to weave the jacquard tissue, and is useful to produce a product requiring various designs while maintaining shape stability.

The leno heddle stack 110 is formed by arranging a plurality of leno heddles 10, disposed to be parallel to a feeding direction of the weft 101, in one or more rows. First warp 102 and second warp 103 are fed through the leno heddles 10, and the warp 102 and 103 fed in this manner and the weft 101 are interwoven to form the leno tissue.

Each of the leno heddles 10 of the leno heddle stack 110 arranged on the same row are parallel to the weft 101, but the leno heddle stack 110 itself is arranged in a direction (warp feeding direction) perpendicular to the weft 101. Further, if two or more rows of leno heddle stacks 110 are provided, the leno heddle stacks 110 constituting the respective rows are arranged in sequence (in series) with respect to the feeding direction of the warp 102 and 103.

Likewise, the jacquard heddle stack 120 is formed by arranging a plurality of jacquard heddles 20, disposed to be parallel to the feeding direction of the weft 101, in one or more rows. Third warp is fed through the jacquard heddles 20. The third warp 104 fed in this way and the weft 101 are interwoven to form the jacquard tissue.

Each of the jacquard heddles 20 of the jacquard heddle stack 120 arranged on the same row are parallel to the weft 101, but the jacquard heddle stack 120 itself is arranged in a direction (warp feeding direction) perpendicular to the weft 101. Further, if two or more rows of jacquard heddle stacks 120 are provided, the jacquard heddle stacks 120 constituting the respective rows are arranged in sequence (in series) with respect to the feeding direction of the warp 102 and 103.

The leno heddle stack 110 and the jacquard heddle stack 120 are preferably arranged such that the leno heddle stack 110 is located at a front portion, and the jacquard heddle stack 120 is located at a rear portion with respect to a direction (warp feeding direction) in which the fabric is woven. That is, the leno heddle stack 110 is preferably nearer to the weft, compared to the jacquard heddle stack 120.

The reason is as follows: if the leno heddle stack 110 is located behind the jacquard heddle stack 120, the size of a shed formed by the leno heddle 10 is excessively increased and the operating width of leno yarn 103 is also excessively increased, thus leading to an increase in defective ratio of the product and a reduction in productivity. This will be explained in more detail in the description of the leno heddle structure.

Although not shown in FIG. 1, the loom for weaving the fabric with the two types of tissue according to the embodiment of the present invention is provided with a single warp beam or a double warp beam around which warp 102, 103, and 104 is wound. The double warp beam is more preferable.

In the case of the double warp beam, it is preferable that the warp (third warp) fed to the jacquard heddle 20 and the standard yarn (first warp) fed to the leno heddle are wound around one warp beam, while the leno yarn (second warp) fed to the leno heddle is wound around the other warp beam. That is, the standard yarn 102 and the leno yarn 103 are preferably wound around different warp beams.

Among two strands of warp participating in weaving the leno tissue, the standard yarn (first warp) 102 is fixed and the leno yarn (second warp) 103 is continuously moved to form a twist structure. As the weaving process proceeds, tension acting on the standard yarn (first warp) 102 and the leno yarn (second warp) 103 may vary. In some cases, the tension acting on the leno yarn (second warp) 103 may increase and thereby the leno yarn (second warp) 103 may break. Therefore, the warp beam feeding the warp is preferably the double warp beam structure to control the tension acting on the standard yarn (first warp) 102 and the leno yarn (second warp) 103, respectively.

Further, depending on the kind of product, it is required to weave a fabric using warp composed of different kinds of yarn. The tension acting on yarn varies depending on the kind of the yarn. In such a case, the use of the single warp beam leads to a reduction in weavability. Therefore, it is preferable to use the double warp beam.

Moreover, even when a double tissue or a tissue of a unique design is woven, it is preferable to use the double warp beam.

Hereinafter, the structure of each of the heddles constituting the leno heddle stack and the jacquard heddle stack, and the leno tissue and the jacquard tissue woven using the heddles will be described with reference to FIGS. 2 to 7.

Figure 2:
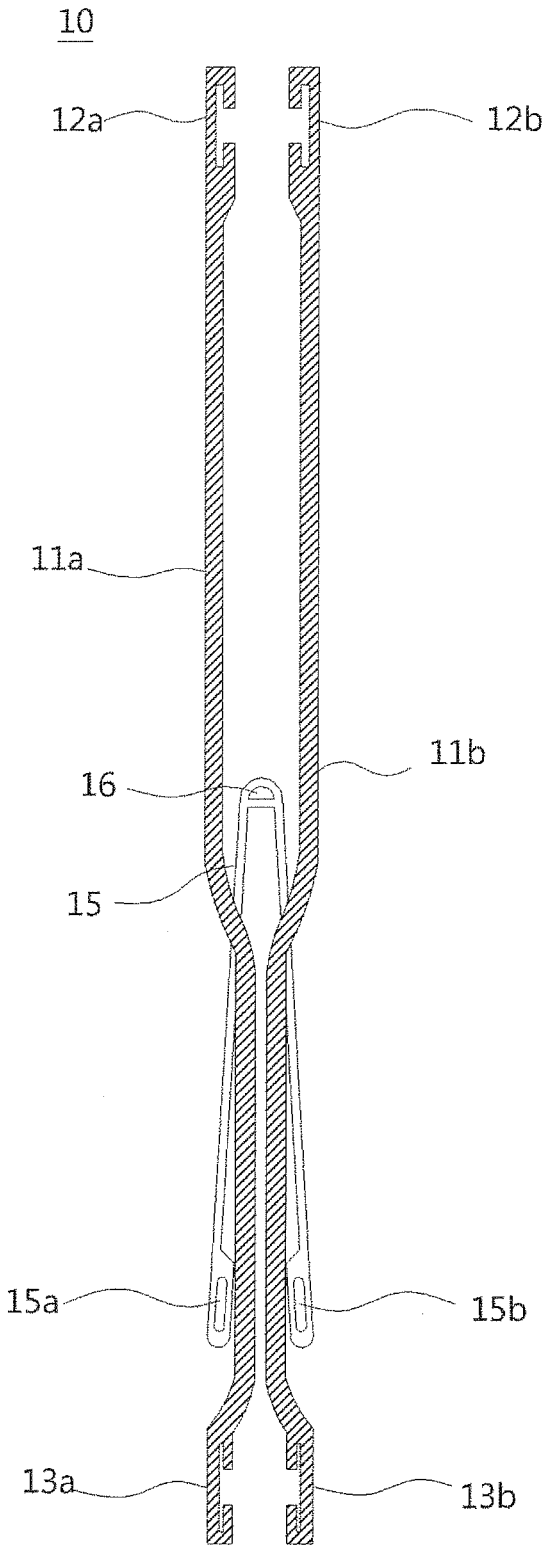
FIG. 2 is a view illustrating a structure of a leno heddle according to an embodiment of the present invention.

Referring to FIG. 2 that illustrates an embodiment of the leno heddle, the leno heddle 10 includes a first needle 11*a*, a second needle 11*b*, and an "A"-shaped third needle 15 having a first warp hole 16.

Hooks 12*a* and 12*b* provided on upper ends of the first needle 11*a* and the second needle 11*b* are connected to harness cords (not shown), respectively, so that the first needle 11*a* and the second needle 11*b* are moved up and down, respectively, as the respective harnesses are pulled or released. Hooks 13*a* and 13*b* provided on lower ends of the first and second needles 11*a* and 11*b* are coupled to springs (not shown) that are secured at first ends thereof to a fixing part. If the pulling of the harness cords is released, the first and second needles 11*a* and 11*b* return to their original positions.

Meanwhile, fastening holes or hooks 15*a* and 15*b* are provided on both ends of the third needle 15 that is the "A"-shaped needle. Thereby, the third needle 15 is coupled at one end thereof to the fixing part, such as a bar, via a spring (not shown). However, since the third needle 15 itself is not connected to the harness cord, the third needle 15 does not move up and down but maintains a fixed position.

Figure 3:
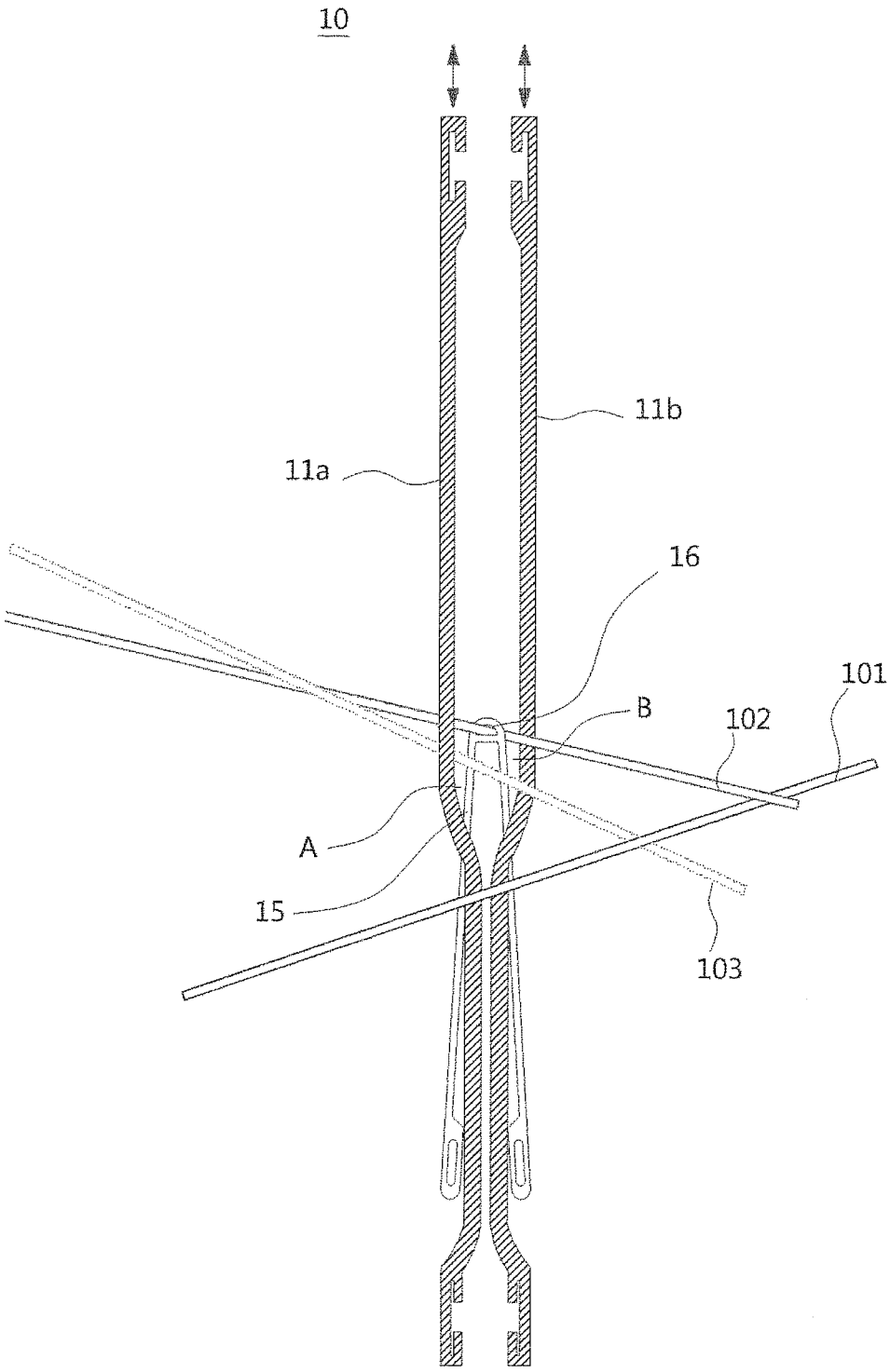
FIGS. 3 and 4 are views illustrating an operation of the leno heddle of FIG. 2.
Figure 4:
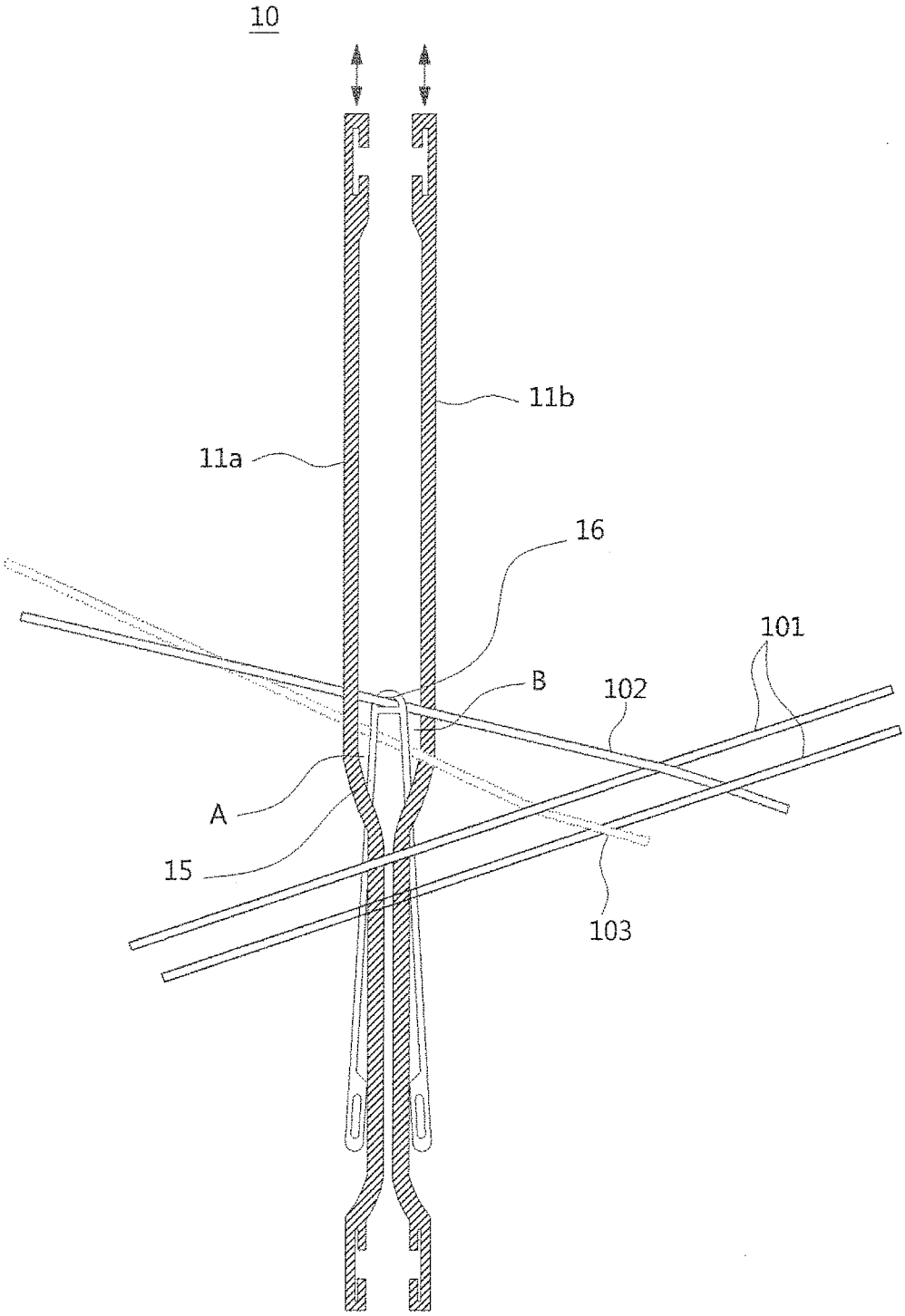

The operating principle of the leno heddle and the process of weaving the leno tissue fabric will be described with reference to FIGS. 2 to 5. FIGS. 3 and 4 are views illustrating the operation of the leno heddle according to an embodiment of the present invention, and FIG. 5 is a view illustrating a structure having a leno tissue woven using the leno heddle.

Figure 5:
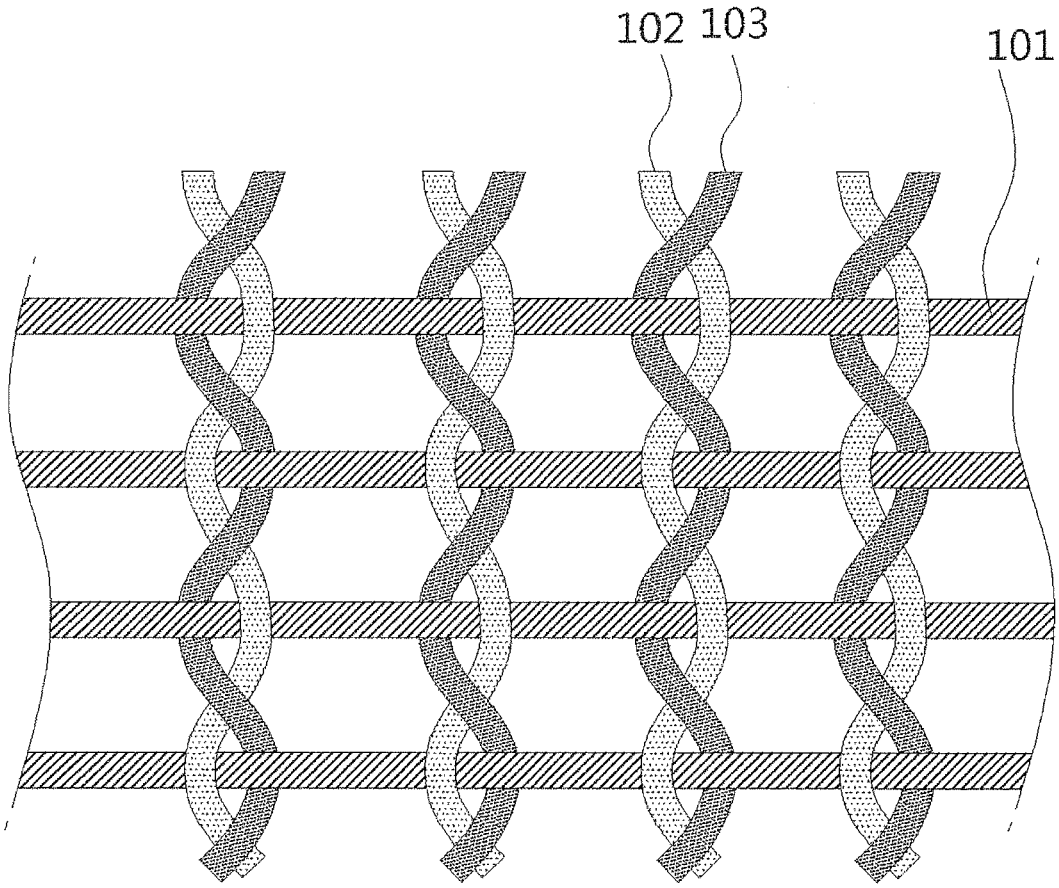
FIG. 5 is a view illustrating a fabric structure having a leno tissue woven using the leno heddle of FIG. 2.

As shown in FIG. 5, the leno fabric is woven by twisting the first warp 102 and the second warp 103 with respect to the weft 101. At this time, as shown in FIGS. 3 and 4, the first warp 102 passes through the warp hole 16 of the third needle 15, and the second warp 103 passes through a space A between the third needle 15 and the first needle 11*a* or a space B between the third needle 15 and the second needle 11*b*.

In the state where the first warp 102 remains fixed at a position passing through the warp hole 16 of the third needle 15 and the second warp 103 is located in the space A, if the first needle 11*a* moves up, the second warp 103 is pushed by the first needle 11*a*, rides over the third needle 15, and then is moved to the space B. In contrast, if the second needle 11*b* moves up, the second warp 103 is pushed by the second needle 11*b* in the space B, rides over the third needle 15, and then is moved to the space A. Therefore, as shown in FIG. 5, the first warp 102 and the second warp 103 assume different positions with respect to the weft feeding position, so that they are twisted to weave the leno fabric.

Here, while the second warp 103 moves to the space A and the space B, a shed is formed by the first warp 102 and the second warp 103 to allow the weft 101 to pass therethrough. The lower the moving width of the second warp 103 is, the lower the defective ratio of the product is. Consequently, it is possible to increase productivity. Therefore, the shed formed by the first warp 102 and the second warp 103 has only to have a size sufficient to pass the weft 101. Thus, in order to minimize the moving width of the second warp 103, the leno heddle stack is preferably nearer to the weft 101 compared to the jacquard heddle stack 120.

Even if the leno fabric is woven with a large weft interval and a large warp interval, the first warp 102 and the second warp 103 create twists, so that a slip rarely occurs at a weaving position and thereby a shape may be stably maintained. The twist tissue structure woven at such a large interval may also guarantee sufficient air permeability.

Figure 6:
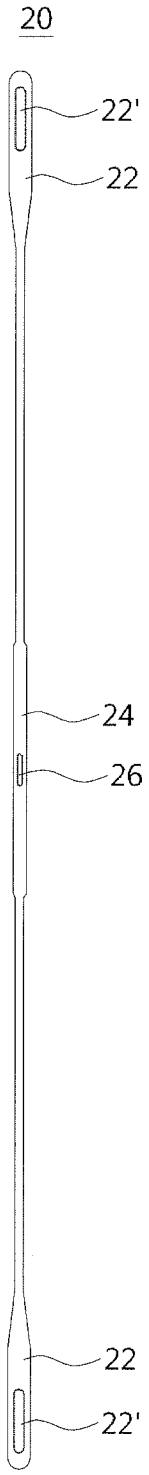
FIG. 6 is a view illustrating a structure of a jacquard heddle according to an embodiment of the present invention.
Figure 7:
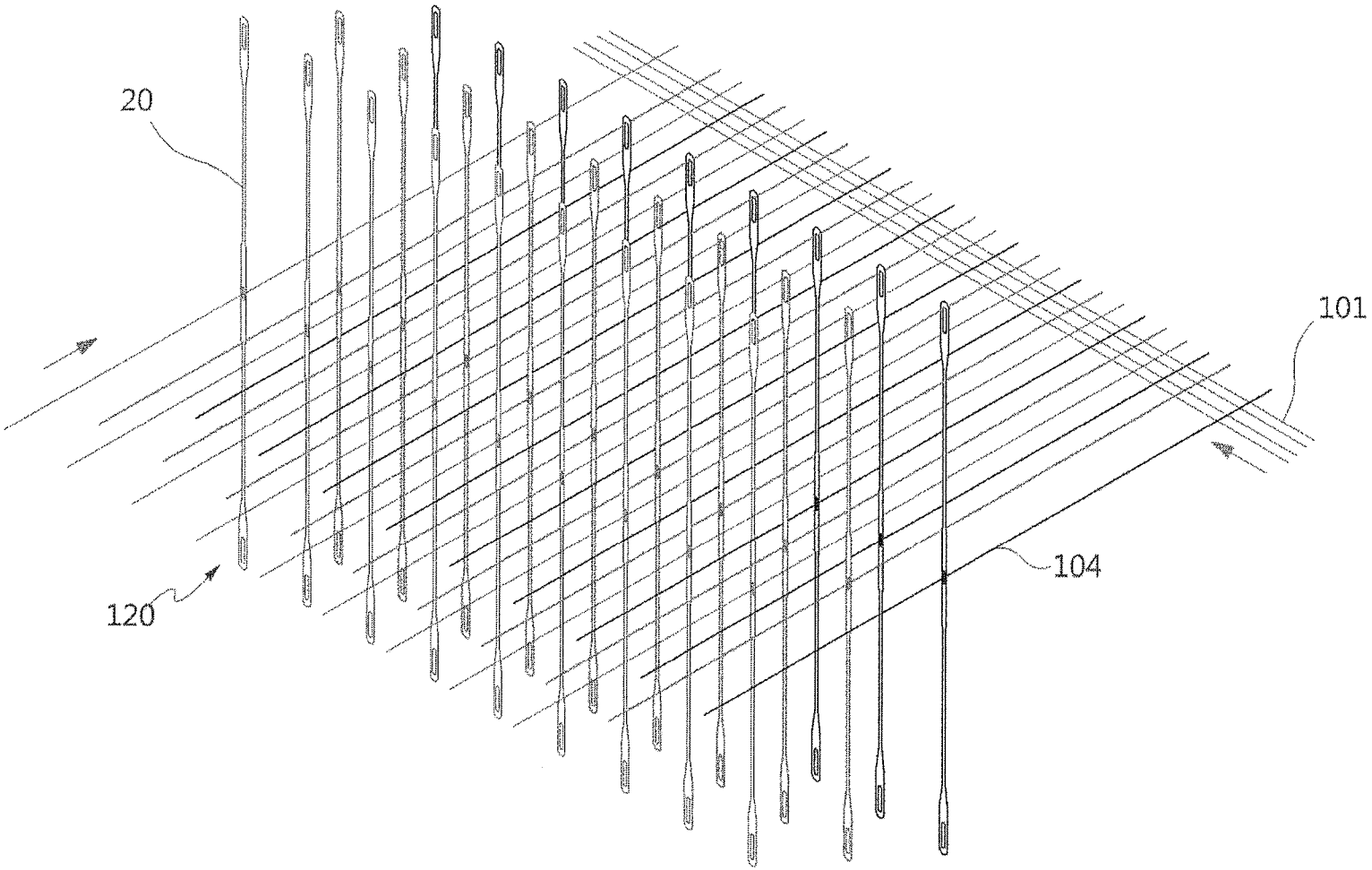
FIG. 7 is a view illustrating a process of weaving a fabric having a jacquard tissue using the jacquard heddle of FIG. 6.

Next, the structure of the jacquard heddles constituting the jacquard heddle stack and the jacquard tissue woven by the jacquard heddle stack will be described with reference to FIGS. 6 and 7. FIG. 6 is a view illustrating the jacquard heddle 20 of the jacquard heddle stack according to an embodiment of the present invention, and FIG. 7 is a view illustrating a process of weaving the jacquard tissue using the jacquard heddle.

Referring to FIG. 6, the jacquard heddle 20 has on a central portion 24 a warp hole 26, with hooks 22' provided on upper and lower ends 22 of the jacquard heddle 20. The hook 22' provided on the upper end of the jacquard heddle 22 is connected to the harness cord (not shown). If the harness cord pulls the hook 22' located at the upper end, the jacquard heddle 22 is moved up. The hook 22' provided on the lower end of the jacquard heddle 22 is connected to a fixing part such as a bar via a spring (not shown). If the pulling of the harness cord is released, the jacquard heddle 22 returns to its original position by the elasticity of the spring. Therefore, the vertical movement of the jacquard heddle 20 may be performed by the jacquard-heddle pulling or releasing action of the harness cord.

The process of weaving the jacquard tissue will be described with reference to FIG. 7. The jacquard tissue fabric is commonly woven by interweaving the fed weft 101 with the warp 104 passing through the jacquard heddle 20. As described above, the jacquard heddle 20 moves up and down, so that the warp 104 passing through the jacquard heddle 20 also moves up and down to be fed.

The vertical movement of the jacquard heddle 20 is programmed and controlled to form the jacquard tissue fabric into a preset design by a control unit (e.g., computer). In this regard, a control may be performed according to the program such that the jacquard tissue structure is closely woven. If necessary, a control may be performed according to the program such that a specific portion is woven to have a loose tissue. Here, a jacquard tissue portion that is loosely woven may serve as the ventilation part.

When the ventilation part is formed by adjusting the density of the jacquard tissue, weaving yarn may be pushed due to the properties of the jacquard tissue or a vent hole of the ventilation part may become narrow in a dyeing process. Accordingly, in order to guarantee the shape stability and the reliable air permeability, as described above, the formation of the ventilation part by the leno tissue is preferably involved.

Figure 8:
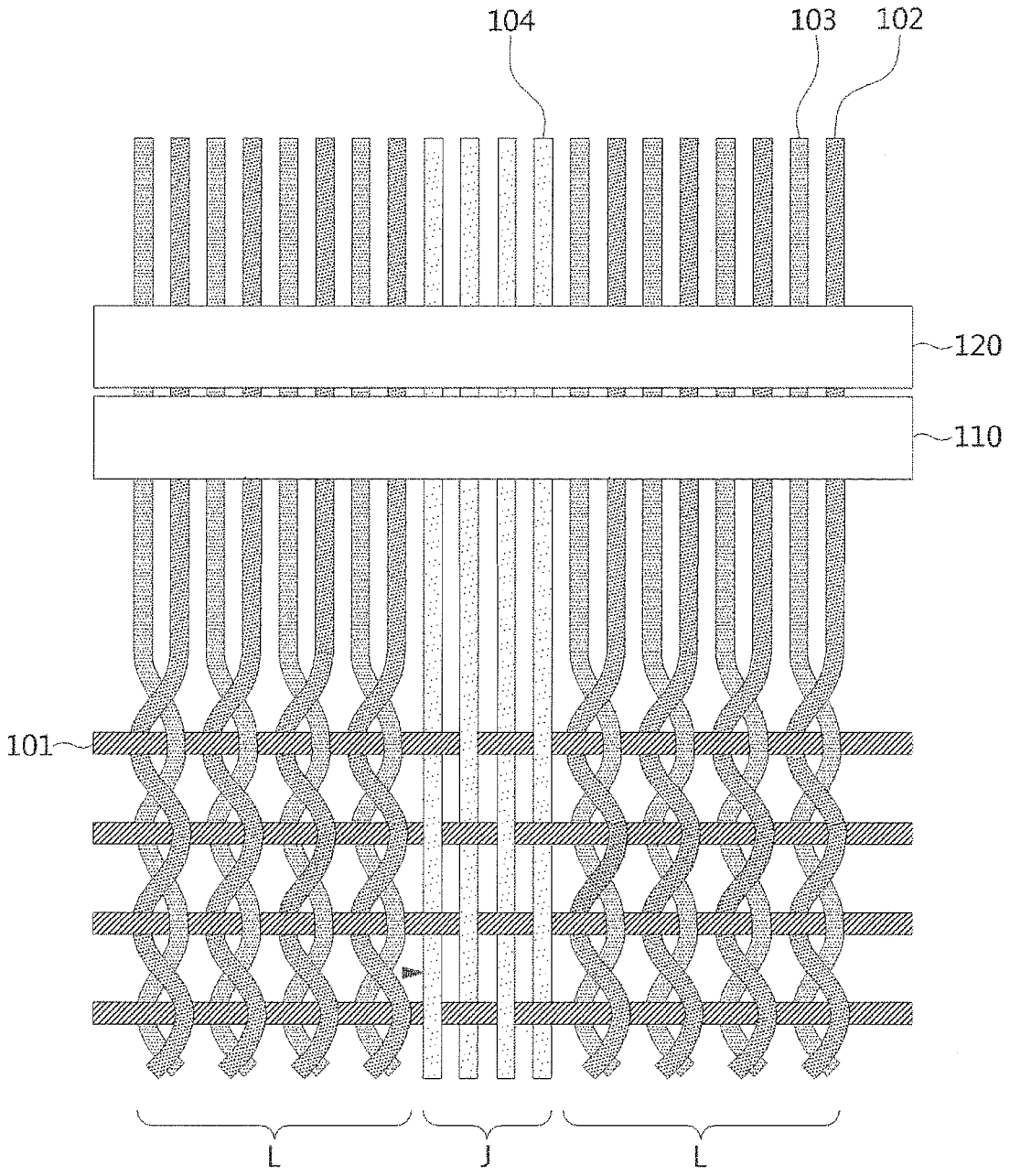
FIG. 8 is a conceptual view schematically illustrating a tissue of a fabric woven by a loom for weaving a fabric with two types of tissue according to an embodiment of the present invention.

As described above, the loom for weaving the fabric with the two types of tissue according to the embodiment of the present invention includes the leno heddle stack 110 for weaving the leno tissue and the jacquard heddle stack 120 for weaving the jacquard fabric. By using the loom for weaving the fabric with the two types of tissue, as shown in FIG. 8, a composite fabric having both the leno tissue and the jacquard tissue may be woven at once. FIG. 8 is a view illustrating a fabric structure woven by the loom for weaving the fabric with two types of tissue according to an embodiment of the present invention.

Referring to FIG. 8, the leno tissue L is formed by interweaving the fed weft 101 with the first warp 102 and the second warp 103 fed from the leno heddles, while the jacquard tissue J is formed by interweaving the fed weft 101 with the third warp 104 of the jacquard heddle. Here, in order to prevent interference between the third warp 104 fed from the jacquard heddle and the first and second warp 102, 103 fed from the leno heddles, it is preferable to appropriately set the position of each heddle.

Since the operation of each heddle of the leno heddle stack 110 and the jacquard heddle stack 120 is individually controlled by a computer, each heddle is consequently operated according to a design that is preset by the program. Thus, the weft 101, the first warp 102, and the second warp 103 are woven into the leno tissue L by the leno heddles, whereas the weft 101 and the third warp 104 are woven into the jacquard tissue J by the jacquard heddles.

The above-described operation allows the two types of tissue, namely, the jacquard tissue and the leno tissue, to be woven through a single weaving process while the weft 101 is continuously fed.

Therefore, the fabric with the two types of tissue may provide high air permeability and shape stability due to the leno tissue structure, and may provide various designs due to the jacquard tissue structure, so that the fabric is very useful to manufacture a shoe upper.

Recently, many consumers require superior functionality and various designs for a shoe. Accordingly, the minimization of the weight of the shoe upper, the increase in air permeability, and the design of the ventilation part are taken as the important elements of a product. Particularly in the case of the athletic shoes, it is very important to provide the air permeability.

Figure 9:
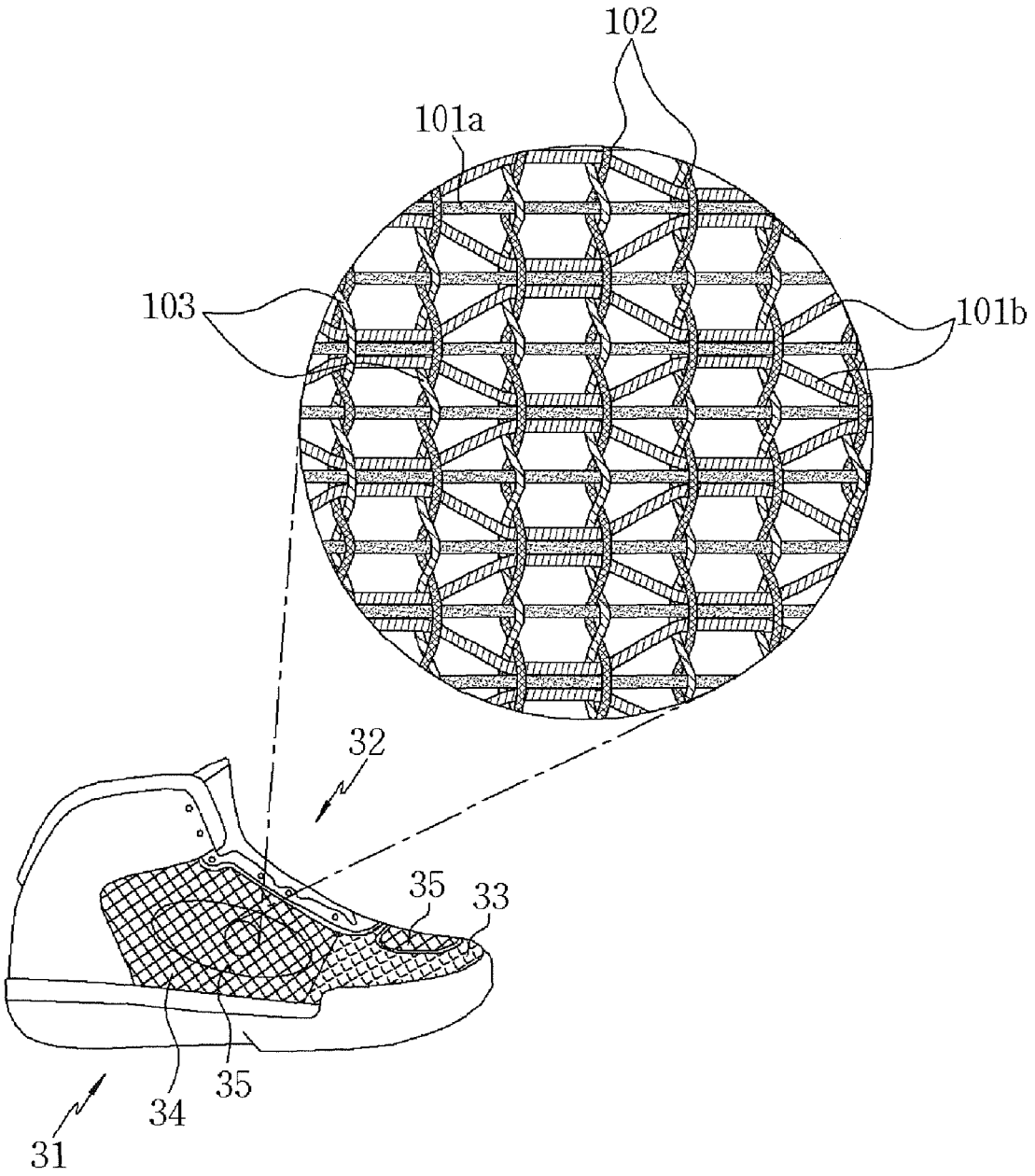
FIG. 9 is a side view illustrating an example of a shoe according to an embodiment of the present invention.

Therefore, in order to maintain shape stability as the shoe while simultaneously satisfying various designs and air permeability, as shown in FIG. 9, it is possible to manufacture a shoe using the two types of tissue fabric.

Hereinafter, the shoe having the shoe upper made of the fabric with the two types of tissue according to the present invention will be described with reference to FIG. 9.

Figure 10:
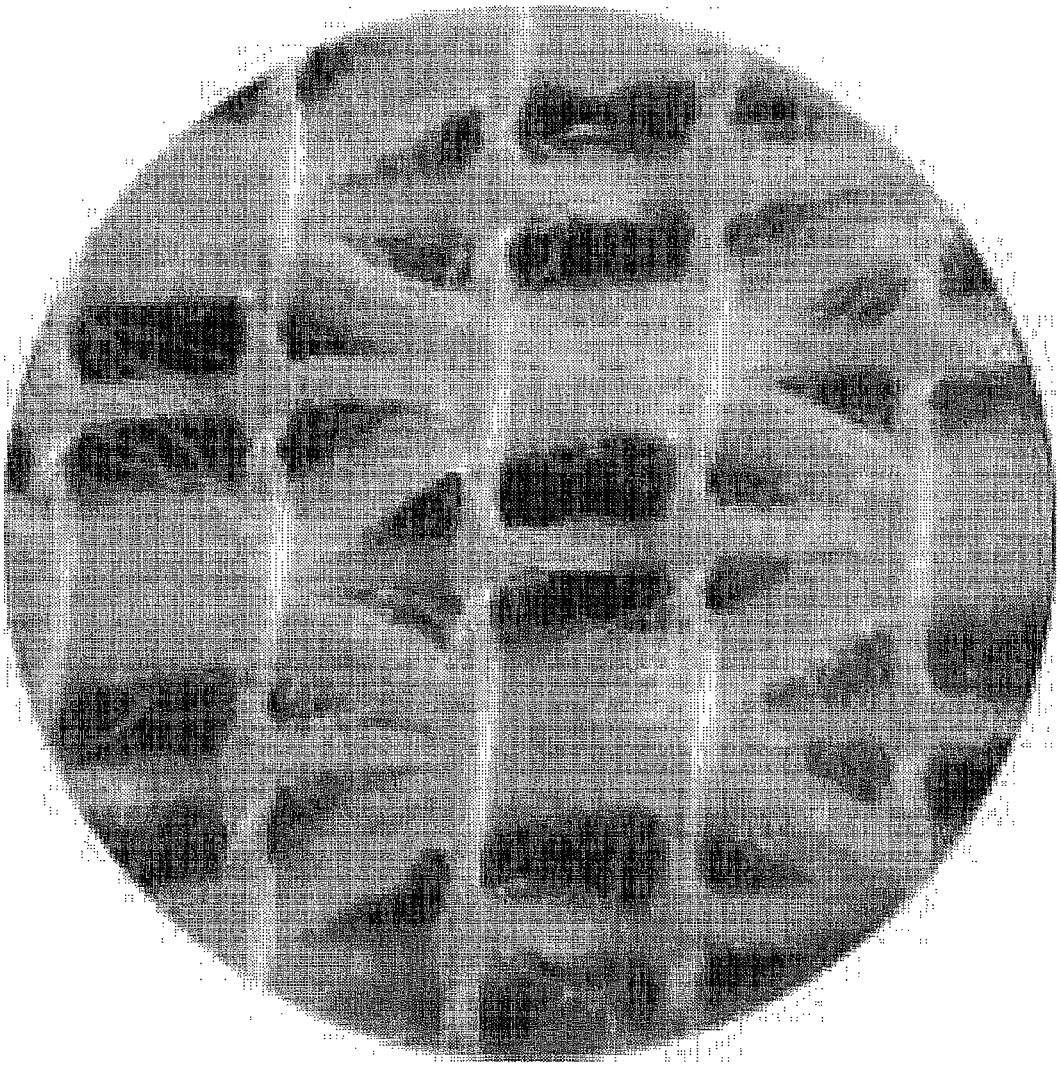
FIG. 10 is an enlarged photograph illustrating a ventilation part of the shoe in FIG. 9.

FIG. 9 is a side view illustrating an example of a shoe according to an embodiment of the present invention, and FIG. 10 is an enlarged photograph illustrating a portion encircled in FIG. 9.

Referring to FIG. 9, the shoe includes an outsole 31 coming into contact with the ground, and a shoe upper 32 coupled to the outsole. The shoe upper 32 according to the embodiment of the present invention includes a front panel portion 33 forming a front region of the shoe, and a side panel portion 34 forming a side region of the shoe.

A shoe surrounds the foot. Thus, if the foot sweats, the interior of the shoe may become humid and an unpleasant smell may be produced. Further, if a wearer strenuously exercises, blood flow increases, and the internal temperature of the shoe may rise due to friction between the ground and the outsole.

Therefore, air permeability for discharging moisture and odor caused by sweat to the outside and cooling the interior of the athletic shoes through air ventilation is a very important function of the shoe. Thus, in the case of general athletic shoes, the ventilation part 35 may be formed on the front panel portion 33 or the side panel portion 34 of the upper.

FIG. 9 is an enlarged view illustrating a portion of the ventilation part 35. As seen from the enlarged ventilation part 35, according to this embodiment, first weft 101*a* and second weft 101*b* are alternately interwoven with the warp 102 and 103 on the basis of two adjacent leno heddles. That is, while two bundles of the first and second warp 102 and 103 surrounding one bundle of weft (first weft 101*a*), the weaving operation is performed. Further, while neighboring two bundles of the first and second warp 102 and 103 surrounding three bundles of weft, that is, neighboring bundle of weft 101*a* and two bundles of weft 101*b* located upstream and downstream of the weft 101*a*, the weaving operation is performed.

The enlarged photograph of the leno tissue woven in this way to form the ventilation part is shown in FIG. 10. As shown in FIG. 10, a polygon (hexagon in this embodiment of FIG. 10) formed by the second weft 101*b* defines a space where a relatively small amount of yarn passes, thus forming the vent hole.

The front and side panel portions 33 and 34 are preferably made of the jacquard tissue that may provide various designs while maintaining the shape of the athletic shoes. The ventilation part 35 is preferably made of the leno tissue, because the air permeability should be secured and a surrounding region of the ventilation part 35 should be firmly held so as to prevent its deformation from occurring.

Therefore, when the shoe is manufactured using the shoe upper woven by the loom according to the present invention, the ventilation part 35 formed of the leno tissue and the panel portions 33 and 34 formed of the jacquard tissue may be simultaneously produced, thus simplifying the process of manufacturing the shoe and remarkably reducing the defective ratio of a product.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A shoe upper woven by a fabric having two types of tissue, comprising:

a first fabric forming a panel to maintain a shape; and a second fabric having a tissue structure different from that of the first fabric, and having a vent hole to form a ventilation part, wherein the first fabric and the second fabric are continuously woven simultaneously, wherein the first fabric is a jacquard tissue fabric, and the second fabric is a leno tissue fabric, wherein the leno tissue fabric is woven by twisting a first warp and a second warp with respect to a weft, and wherein one of the first warp and the second warp is positioned on the weft and the other is positioned under the weft.

2. The shoe upper according to claim 1, wherein the first fabric comprises a ventilation part having a vent hole formed depending on a tissue density, and the second fabric comprises the ventilation part having the vent hole due to the tissue structure thereof.

3. A shoe comprising the shoe upper according to claim 1.

4. A fabric with two types of tissue, comprising:

a first fabric forming a panel to maintain a shape; and a second fabric including a tissue structure different from that of the first fabric, and including a vent hole to form a ventilation part, wherein the first fabric and the second fabric are continuously woven simultaneously, wherein the first fabric is a jacquard tissue fabric, and the second fabric is a leno tissue fabric, wherein the leno tissue fabric is woven by twisting a first warp and a second warp with respect to a weft, and wherein one of the first warp and the second warp is positioned on the weft and the other is positioned under the weft.

5. A shoe upper woven by a fabric having two types of tissue, comprising:

a first fabric forming a panel to maintain a shape; and a second fabric having a tissue structure different from that of the first fabric, and having a vent hole to form a ventilation part, wherein the first fabric and the second fabric are continuously woven simultaneously, wherein the first fabric is a jacquard tissue fabric, and the second fabric is a leno tissue fabric, wherein the leno tissue fabric is woven by twisting a first warp and a second warp with respect to at least one of a first weft and a second weft, wherein the first weft and the second weft are alternately interwoven with the first warp and the second warp by interweaving for two bundles of the first warp and second warp surrounding one bundle of the first weft and neighboring two bundles of the first warp and second warp surrounding one bundle of the first weft and two bundles of the second weft, and wherein the two bundles of the second weft are located upstream and downstream of the one bundle of the first weft.

* * * * *